United States Patent [19]

Sardella et al.

[11] Patent Number: 4,744,297

[45] **Date of Patent: * May 17, 1988**

[54] MOUNTING PRINTING PLATES

[75] Inventors: Louis M. Sardella; John B. West, both of Cockeysville; John R. Harrison, Baltimore, all of Md.; Dennis J. Parr, York, Pa.; Edward H. Harrison, Jarrettsville, Md.

[73] Assignee: The Ward Machinery Company, Cockeysville, Md.

[ * ] Notice: The portion of the term of this patent subsequent to Aug. 4, 2004 has been disclaimed.

[21] Appl. No.: 858,934

[22] Filed: May 1, 1986

Related U.S. Application Data

[63] Continuation-in-part of Ser. No. 776,775, Sep. 17, 1985, Pat. No. 4,683,822.

[51] Int. Cl.[4] ..... B41F 27/06; B41F 27/12

[52] U.S. Cl. ..... 101/382 MV; 101/415.1

[58] Field of Search ..... 101/382 R, 382 MV, 375, 101/376, 378, 415.1; 269/21; 51/235; 83/481, 100, 152, 698; 279/3; 493/60, 64; 137/454.5

[56] References Cited

U.S. PATENT DOCUMENTS

| | | | |
|---|---|---|---|
| 2,033,205 | 3/1936 | Poppe | 101/415.1 |
| 2,198,765 | 4/1940 | Featherstone et al. | 279/3 X |
| 2,680,994 | 6/1954 | Wood | 269/21 |
| 2,727,463 | 12/1955 | Foster, Jr. | 101/415.1 |
| 2,923,235 | 2/1960 | Voegelin | 101/382 MV |
| 3,078,796 | 2/1963 | Kamata et al. | 101/378 |
| 3,110,107 | 11/1963 | Wilhelm | 101/382 MV |
| 3,294,392 | 12/1966 | Dunham | 51/235 X |
| 3,295,443 | 1/1967 | Devon | 101/376 |
| 3,670,646 | 6/1972 | Welch, Jr. | 101/382 MV |
| 3,907,268 | 9/1975 | Hale | 269/21 |
| 4,005,653 | 2/1977 | Arkell | 101/382 MV |
| 4,056,057 | 11/1977 | Smith | 101/382 MV |
| 4,089,265 | 5/1978 | White et al. | 101/375 |
| 4,237,466 | 12/1980 | Scranton | 101/382 MV X |
| 4,471,802 | 9/1984 | Pryor | 137/454.5 X |
| 4,479,435 | 10/1984 | Takeuchi et al. | 101/382 MV |

FOREIGN PATENT DOCUMENTS

| | | | |
|---|---|---|---|
| 691312 | 2/1967 | Belgium . | |
| 2196910 | 3/1974 | France . | |
| 121647 | 9/1980 | Japan | 269/21 |
| 132938 | 8/1982 | Japan | 269/21 |
| 1182511 | 2/1970 | United Kingdom . | |
| 2073909 | 10/1981 | United Kingdom . | |

*Primary Examiner*—Charles A. Pearson

*Attorney, Agent, or Firm*—Boyce C. Dent; Edward D. C. Bartlett

[57] ABSTRACT

Apparatus for mounting a flexible printing plate comprises a printing cylinder having a surface upon which the printing plate is mountable, and a connection for applying subatmospheric pressure inside the cylinder. A plurality of valves selectively apply the subatmospheric pressure to the surface from inside the cylinder. These valves have depressable actuating members protrudable above the cylinder surface. Those actuating members contacted by the printing plate when applied to the cylinder surface are depressed thereby to effect application of subatmospheric pressure to beneath the printing plate to draw the plate against the cylinder. Preferably, grooves are provided in the cylinder surface for distribution of the subatmospheric pressure beneath the plate. Advantageously, the printing plate may have a thin, highly flexible and deformable fringe along its trailing edge to seal the surface grooves, at that location. This mounting arrangement facilitates quick changing of printing plates during printing operations.

11 Claims, 17 Drawing Sheets

MOUNTING PRINTING PLATES

CROSS REFERENCE TO RELATED APPLICATION

This application is a continuation-in-part of copending application Ser. No. 776,775 filed Sept. 17, 1985, now U.S. Pat. No. 4,683,822. Insofar as any of the disclosure in copending patent application Ser. No. 776,775 is omitted from the present application, all of such omitted disclosure is hereby incorporated herein by reference.

FIELD OF THE INVENTION

This invention relates to printing apparatus, particularly rotary printing apparatus, and arrangements for mounting printing plates. The invention particularly relates to mounting flexible printing plates on printing cylinders for use in the corrugated paperboard industry.

BACKGROUND OF THE INVENTION

The corrugated paperboard industry uses flexible printing plates or dies on a rotating cylinder to transfer ink to the surface to be printed and serrated edge cutting rules on a rotating cylinder acting against a soft anvil roll to die cut the printed sheets. Such apparatus is generally called flexographic printer die cutters which apparatus, among other things, feeds individual sheets of corrugated paperboard past a rotating printing die to print indicia on the sheets and past a rotating die cylinder to die cut the sheets.

One problem associated with such machines has been the mounting of the printing die to the print cylinder, particularly, quick mounting of the printing die so as not to delay set-up of the machine during a change from one sheet size to another and/or a change in the indicia to be printed on the sheet. The printing dies themselves are usually made of a type of rubber or plastic mounted on a backing sheet of heavy paper, rubber, or plastic material. The backing sheet is flexible so that it can be wrapped around the print cylinder.

An early means of mounting the printing die to the cylinder was merely to staple the backing sheet to a wooden covering on the cylinder. This left much to be desired since the staples eventually ruined the wooden covering and the backing sheet making it necessary to recover the cylinder and, more often, to replace the backing sheet or the complete die. In addition, if the printing die was not placed properly on the cylinder, it had to be removed and repositioned thus resulting in additional set-up time.

Since then, various means have been employed to mount the printing die to the print cylinder. One such means required a rigid strip on each end of the die backing of which one was captured in an immovable slot in the print cylinder and the other captured in a movable slot. The movable slot included a hinged portion movable in a direction away from the immovable slot so as to tension the backing sheet. The hinge portion was moved by a pneumatically expandable tube. The die backing had to be made quite precisely and tube failures were not uncommon.

Another means uses a rigid U-shaped hook strip on one end of the backing sheet that hooks in a mating U-shaped slot in the print cylinder, the so-called "Dorr" system. The other end of the sheet is made similar to a roll-up window blind with the roller placed in a slot in the print cylinder. A special tool is used to wind up the roller to tension the backing sheet to hold it tightly against the cylinder. Making the backing sheet is quite complex and expensive. In addition, relatively considerable time is required to roll up the backing sheet in the cylinder.

Probably the most popular means in current use is the so-called "Matthews" system which includes a U-shaped hook strip on one end of the backing sheet that hooks in a mating U-shaped slot in the print cylinder. A number of elastic straps are fastened to the other end of the backing sheet. Each strap has a U-shaped hook that hooks into a mating U-shaped slot in the cylinder. The elastic straps tension the backing sheet tightly against the cylinder. Making the backing sheet with straps is fairly complex and expensive and some time is required to fasten each individual strap in the slot in the cylinder.

All of the above means rely on tension to hold the backing sheet tightly against the printing cylinder. However, tension is not always necessary as evidenced by the so-called "Magna Graphics" system which uses a backing sheet of ferrous material held to the cylinder by permanent magnets embedded in the cylinder's surface. Thus, both the backing sheets and the cylinder are expensive to make. In addition, any loose ferrous materials around the press are attracted to the cylinder which can damage the ink transfer roll that transfers ink to the printing die.

SUMMARY OF THE INVENTION

It is an object of the present invention generally to provide a rapid mounting means for printing dies.

Another object of the present invention is to provide a printing plate mounting arrangement that is relatively simple and inexpensively constructed and that will hold the printing plates tightly against the printing cylinders upon which they are mounted.

Yet another object of the present invention is to provide a printing plate mounting arrangement for a printing cylinder which simplified changing of printing plates.

A feature by which the above objects are achieved is the utilization of subatmospheric pressure in the printing cylinder to hold the printing die against the cylinder in combination with valves which have protruding actuating members actuated by the printing die, whereby the subatmospheric pressure is only applied to the area beneath the printing die. This has the advantage that the printing die is held firmly on the cylinder by vacuum, and the size and shape of the printing die automatically determines where the vacuum is to be applied.

It is an object of one aspect of the present invention to provide a printing die having automatic vacuum sealing at its trailing end. A feature by which this is achieved is the attachment of a highly flexible fringe strip to the trailing end of the printing die. This has the advantage that the vacuum applied under the printing die will cause this fringe strip to flex and conform to the surface configuration of the cylinder at the trailing end of the printing plate to form an effective seal.

Accordingly, therefore, there is provided by the present invention an apparatus for mounting a printing plate comprising a rotatable cylinder having a surface on which the printing plate is to be mounted, means for connecting an interior of the cylinder to a source of vacuum, a plurality of passages between the interior and the surface of the cylinder for application of vacuum to the surface, and valve means associated with the passages for opening and closing the passages to control the application of vacuum to the surface, the valve means having depressable actuating members which protrude above the surface when the valve means close the passages. The actuating members are individually depressed by the printing plate when mounted on the surface thereover to effect application of vacuum to the surface beneath the printing plate.

Preferably the surface has grooves therein, and the passages communicate with these grooves for distributing the vacuum beneath the printing plate. These grooves preferably extend transversely to and are spaced apart along an axial direction of the cylinder.

A stop bar may be embedded in the surface, the stop bar extending along the axial direction of the cylinder and traversing the grooves to form a closed beginning of each groove. Preferably the valve means comprises a plurality of valves disposed adjacent said stop bar at the beginning of the grooves.

According to one embodiment of the invention, the print cylinder includes a plurality of laterally spaced recesses and annular grooves in its outer surface in communication with a suction means to apply subatmospheric pressure to the recesses and grooves. Thus, the backing sheet of a printing die placed on the surface of the cylinder is held in place by the subatmospheric pressure in the grooves. A pivotable valve in each recess pivots automatically upon placement of the die on the cylinder to let subatmospheric pressure from within the cylinder into only those grooves beneath the die. A laterally extending stop strip divides each annular groove into a segment extending annularly substantially around the cylinder. The recesses may be formed in the cylinder but are preferably formed as notches in the stop strip. And, auxiliary gate strips may be placed at fixed locations around the periphery of the cylinder to, upon actuation, effectively shorten the grooves to accommodate dies having a length less than the full circumference of the cylinder. The stop strip also serves to align the die when it is mounted on the cylinder. If desired, the stop strip may also include a U-shaped slot for mating engagement with a U-shaped strip on the leading edge of the die to facilitate mounting.

According to another aspect of the present invention there is provided a printing plate comprising a flexible body portion with a strip of highly flexible and pliable sheet material connected thereto and forming a fringe extending from a trailing edge of the body portion. This fringe is readily deformable by vacuum into any vacuum distribution grooves of the printing cylinder upon which the printing plate is mounted and held in position by vacuum. The fringe functions to seal such grooves adjacent the trailing edge of the body portion. This fringe may take the place of the auxiliary gate strips mentioned above.

Preferably, the sheet material of the fringe is also resiliently deformable, and may be significantly thinner than the material of the body portion of the printing plate.

Advantageously, a magnetic strip may be connected to the body portion adjacent the trailing edge thereof to facilitate initial mounting of the printing plate on the cylinder and also to help retain the printing plate on the cylinder when the vacuum is not being applied.

The above printing plates may advantageously form part of the printing plate mounting arrangement of the present invention.

Other objects, features and advantages of the present invention will become more fully apparent from the following detailed description of the preferred embodiments, the appended claims and the accompanying drawings.

DETAILED DESCRIPTION OF THE PREFERRED EMBODIMENTS

The preferred embodiment of the invention is illustrated in FIGS. 11 to 17. This is a modification of the embodiment of the invention illustrated in FIGS. 1 to 8 which will be described first, followed by the modifications shown in FIGS. 9 and 10.

Figure 1:
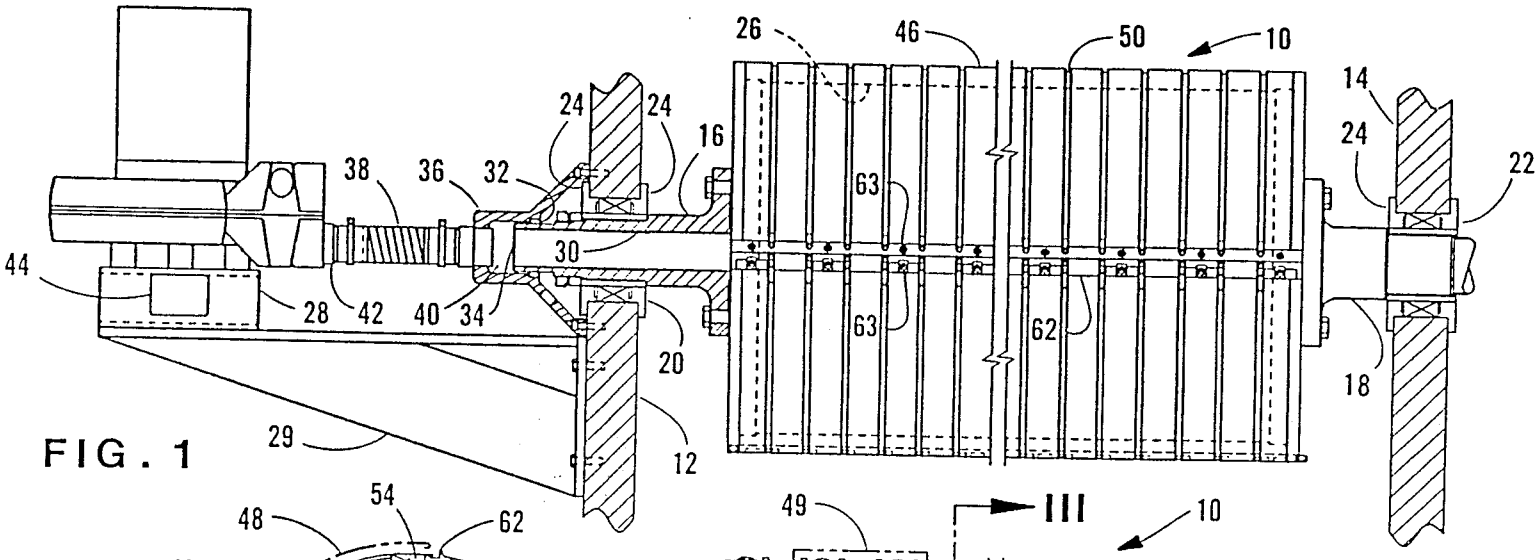
FIG. 1 is a front elevation in partial cross-section showing a printing cylinder according to the invention with laterally spaced annular recesses and grooves for applying subatmospheric pressure, to a printing plate placed on the cylinder, from a suction means connected to the end of the cylinder.

Referring now to FIG. 1, a printing cylinder, generally denoted by numeral 10, is journaled for driven rotation between a pair of stationary support members 12 and 14 by means of journals 16 and 18 supported in roller bearings 20 and 22 themselves retained in support members 12 and 14 by bearing retainers 24. Printing cylinder 10 is rotated in the conventional manner by a gear (not shown) secured to the end of journal 18 that is itself driven by other gears (not shown) in the gear train of the machine.

Printing cylinder 10 has a hollow interior 26 sealed to atmosphere but connected to a suction means 28 which creates subatmospheric pressure, i.e. a vacuum, in the interior 26. Suction or vacuum means 28 may be, for example, a model VFC 503A-7W ring compressor (blower) made by the Fuji Electric Corp. of America and available from Virginia Fluid Power, 8412 Sandford Drive, Richmond, VA. 23230. The suction means 28 is supported on a bracket 29 mounted to the support 12.

Journal 16 includes an air passage 30 in communication with the interior 26 of cylinder 10. A ring seal 32 surrounds a necked-down portion 34 of journal 16 and is encased within a seal holder 36 secured to the support means 12. A flexible hollow tube 38 connects a chamber 40 of seal holder 36 to an intake manifold 42 of the suction means 28. The seal mounting arrangement permits the cylinder 10 to rotate while providing a substantially air-tight connection between the suction means 28 and cylinder 10. Thus, upon operation of suction means 28, air is withdrawn from within the hollow interior 26 of cylinder 10 and discharged to atmosphere through an exhaust manifold 44 of suction means 28 thereby creating subatmospheric pressure within the hollow interior 26 of cylinder 10.

Still referring to FIG. 1, cylinder 10 includes an annular die mounting surface 46, for holding a printing die in the form of a flexible printing plate 48 (shown schematically by phantom lines in FIG. 3 and spaced away from the surface 46 for clarity), the mounting surface 46 extending from one end of the cylinder to the other. Suction means for holding the die or printing plate 48 onto the surface 46 includes a number of laterally spaced annular grooves 50 formed in the surface 46 in communication with adjoining recesses 56 (see FIG. 5). A hole 52 in the cylinder 46 beneath each recess 56 connects each recess to the hollow interior 26 thereby directing subatmospheric pressure into each groove 50.

Since subatmospheric pressure is directed into each groove 50, it can be seen that, if there is to be no leakage of atmosphere between the die 48 and the die mounting surface 46, the die 48 must cover the entire cylinder completely around its circumference and from end to end. However, printing dies with printing areas as large as the complete die mounting surface 46 are seldom required. Although a backing sheet portion 49 of the die 48 can be as large as the mounting surface 46 with smaller printing areas thereon, such arrangement is not desirable. Instead,it is preferable to have the backing sheet only slightly larger than the printing areas of the die such as indicated schematically in FIG. 3.

Accordingly, the invention preferably includes a selectively operable adjustment means on the cylinder 10 for directing the subatmospheric pressure to only that portion of the die mounting surface 46 beneath the printing die 48 when the die is placed on the cylinder. Such adjustment means includes lateral adjustment means for controlling the width in increments along the cylinder 10 to which subatmospheric pressure is applied and annular adjustment means for controlling the circumferential length in increments around the cylinder to which subatmospheric pressure is applied The lateral adjustment means includes a pivotable valve 54 (as shown in detail in FIGS. 4–6) recessed in the recess 56 formed in alignment with each groove 50. Each recess 56 may be formed in the cylinder 46 but is preferably formed as a notch 56 in a stop bar 62 to be described. The valve 54 is loosely pivoted about a pin 58 pressed in a groove 60 (see FIG. 4) in the bottom of the laterally extending stop bar 62 recessed in the die mounting surface 46. When a printing die 48 is not in place over the valve 54, the subatmospheric pressure in hole 52 causes valve 54 to pivot counterclockwise as viewed in FIG. 5 and thereby close the hole 52, and keep it closed, to subatmospheric pressure within the hollow interior 26. Thus, without a printing die in place, all the holes 52 are closed and no subatmospheric pressure is present in grooves 50. A conventional vacuum relief valve (not shown) is preferably connected to the intake manifold 42 so that when all the holes 52 are closed by either the valves 54 or by being covered by a die 48, atmosphere will be drawn through the relief valve and into the suction means 28 to prevent overheating of the suction means. The relief valve is pre-set to the pressure desired to hold the die 48 to the die mounting surface 46.

Figure 2:
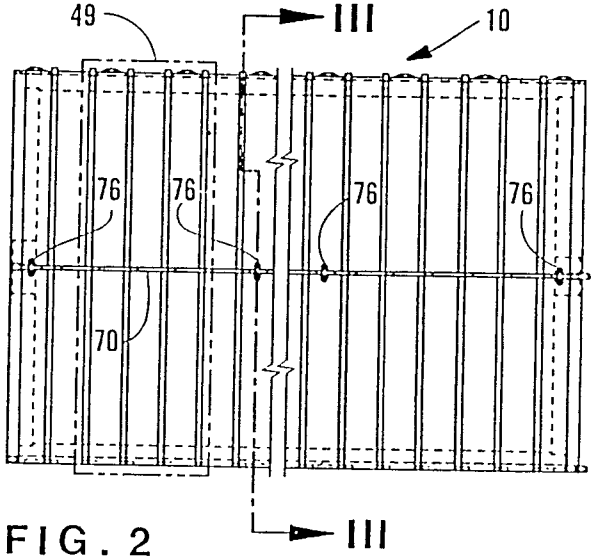
FIG. 2 is a front elevation of the printing plate mounting surface of the printing cylinder of FIG. 1 rotated 90 degrees from that shown in FIG. 1.
Figure 6:
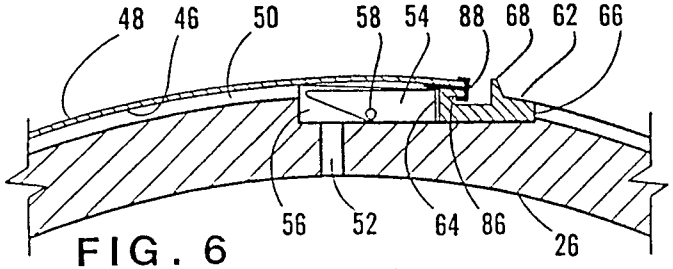
FIG. 6 is a cross-sectional view similar to that of FIG. 5 showing the valve opened by mounting of the printing plate to direct subatmospheric pressure into the grooves.

As shown in FIG. 6, when a printing die 48 is placed over the valves 54, the die automatically pivots the valves 54 clockwise that are beneath the die, thereby opening the holes 52 to apply subatmospheric pressure to the grooves 50 that are beneath the die and which then hold the die firmly against the die mounting surface 46. As shown in FIG. 2, the width of the backing sheet portion 49 of the die (shown in phantom lines for clarity) is made such that its lateral edges cover the grooves 50 at the edges of the sheet. In this way, the subatmospheric pressure is limited to those grooves 50 that are beneath the die 48. The incremental width of the backing sheet 49 is determined by the printing areas of the die and the spacing between the grooves 50.

Figure 4:
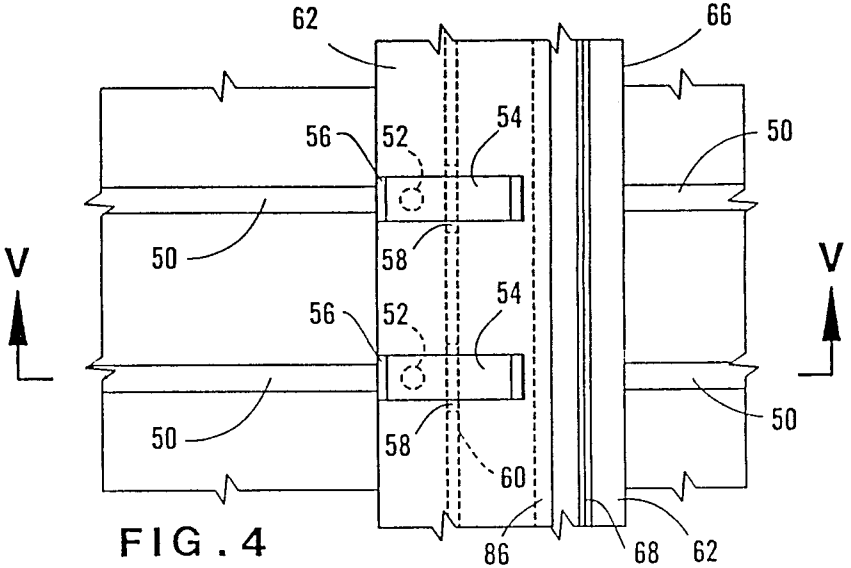
FIG. 4 is an enlarged plan view of a portion of the stop bar and valves on the printing cylinder shown in FIG. 1.
Figure 5:
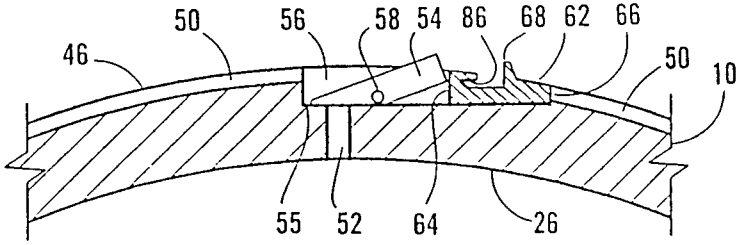
FIG. 5 is a cross-sectional view of the stop bar and valves of FIG. 4 taken along the line V—V thereof and showing a valve blocking the flow of subatmospheric pressure from within the cylinder.

The annular adjustment means includes a first stop bar 62 recessed in the die mounting surface 46 and extending transverse to the direction of the grooves 50, as shown generally in FIG. 1 and in greater detail in FIGS. 4–6. It is held in place by screws 63 extending through the bar and threaded into surface 46 (see FIG. 1). Stop bar 62 serves to form a leading end 64 and a trailing end 66 in each of the grooves 50 (see FIG. 5). Although not essential, the bar 62 preferably includes an upstanding portion 68 that functions as a stop for the leading end of the die 48 when it is first placed on the die mounting surface 46. This permits the die 48 to be placed squarely on the die mounting surface 46 and also assures registration of the die in the circumferential direction as will be readily understood by those skilled in the art.

Figure 3:
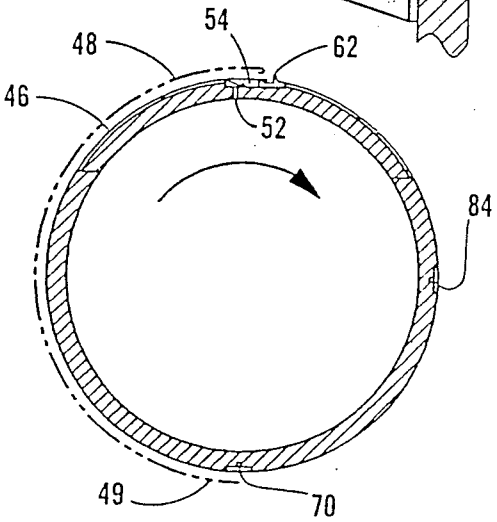
FIG. 3 is a cross-sectional view of the cylinder of FIG. 2 taken along the line III—III of FIG. 2.
Figure 7:
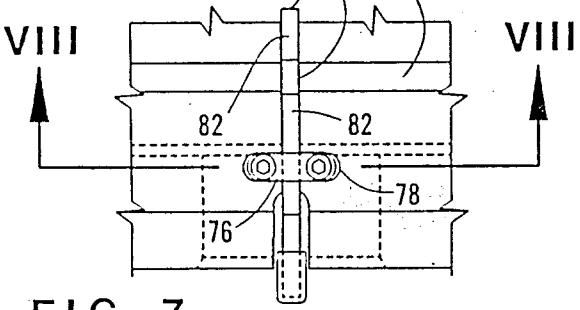
FIG. 7 is an enlarged plan view of a portion of the auxiliary gate bar on the printing cylinder shown in FIG. 2.
Figure 8:
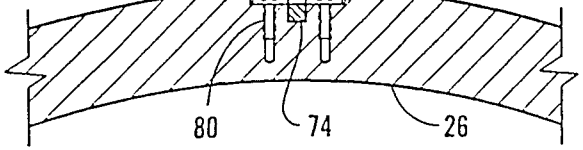
FIG. 8 is a cross-sectional view of the auxiliary gate bar of FIG. 7 taken along the line VIII—VIII thereof and showing the mounting of the auxiliary gate bar.

A second gate bar 70 is placed at 180 degrees from the first stop bar 62 to conform to industry practice as to circumferential location (see FIG. 3). As shown in FIG. 2, 7 and 8, the second bar 70 also extends transverse to the direction of grooves 50. Bar 70 serves to form another trailing end stop 72 in the grooves 50 so that a shorter die 48 may be used when the printing surface of the die does not extend completely around the cylinder 10.

The second bar 70 is recessed in groove 74 in the die mounting surface 46 as best shown in FIGS. 7 and 8. It is held in place by several retaining plates 76 spaced across the width of the surface 46 (see also FIG. 2). The retaining plates 76 are recessed in slots 78 and held in place by screws 80 threaded into the die mounting surface 46. The top of the bar 70 is flush with the die mounting surface 46 except for notches 82 between the grooves 50 as best shown in FIG. 7. The notches 82 also pass beneath the retaining plates 76 which are secured in the recesses 78 so as to hold the bar 70 snugly in groove 74 but still permit it to slide laterally in the groove 74. Thus, in the position shown in FIG. 7, the bar 70 blocks the grooves 50 and forms the trailing end stop 72. In this way, the subatmospheric pressure extends in grooves 50 from the leading end stop 64 at the first bar 62 to the trailing end stop 72 and, in conjunction with the valves 54, limits the application of the subatmospheric pressure in grooves 50 to only the area beneath the backing sheet. Thus, the backing sheet need only extend from just over the first bar 62 to just over the second bar 70 as shown schematically in FIG. 3.

However, when it is desired to use a full wrap die (substantially 360 degrees circumferential length), the bar 70 is merely pushed laterally (upward as viewed in FIG. 7) by hand until the notches 82 in bar 70 are aligned with grooves 50 in the die mounting surface 46. This permits the subatmospheric pressure to continue in grooves 50 to the trailing end stop 66 thereby accommodating a full wrap die. In this manner, there is provided a selectively operable adjustment means to direct the subatmospheric pressure to only that portion of the printing die mounting surface that is beneath the die 48.

Again, to conform to industry practice, another bar 84 is provided at about 270 degrees from the first stop bar 62 in the counterclockwise direction as viewed in FIG. 3. Bar 84 is in all respects like bar 70, including its installation in die mounting surface 46; thus, no further description is required. Bar 84 permits the use of a printing die whose circumferential length is approximately three-fourths of the circumference of cylinder 10.

Although not essential, the first stop bar 62 may include a U-shaped slot 86, as best shown in FIGS. 5 and 6, to accommodate a mating U-Shaped strip 88 on the leading edge of the backing sheet. The strip 80 may be of the type used with the Matthews system previously described. It is stapled and/or glued to the backing sheet and, when inserted in the slot 86, provides a firm anchor for the leading edge of the backing sheet. This is helpful, especially when full wrap dies are used, because of limited accessibility to the print cylinder in letter presses. Thus, the die 48 may be hooked to the first stop bar and the cylinder 10 rotated slowly by electrical means, as will be readily understood by those skilled in the art, so that the operator can hold the trailing end or sides of the die during such rotation and guide it into place on the die mounting surface 46.

The size of grooves 50, their lateral spacing, and the magnitude of the subatmospheric pressure are not critical. It has been found, with a nominal 66 inch circumference print cylinder 10, that grooves 50 laterally spaced about 2 inches on center with the subatmospheric pressure at about 27–30 inches of water, the die 48 is held firmly on the cylinder at rotations up to 170 R.P.M. with the width of the grooves about 0.312 inches and their depth about 0.187 inches. However, the depth of the grooves may be very shallow, on the order of 15 to 20 thousandths of an inch deep. There seems to be not point in making them deeper than 0.187 inches since distribution of the subatmospheric pressure is not enhanced by greater depth.

If the grooves are wider than about 0.312 inches, the backing sheet may belly into the groove, depending on the stiffness of the flexible backing sheet, which is detrimental to the printing operation.

Figure 9:
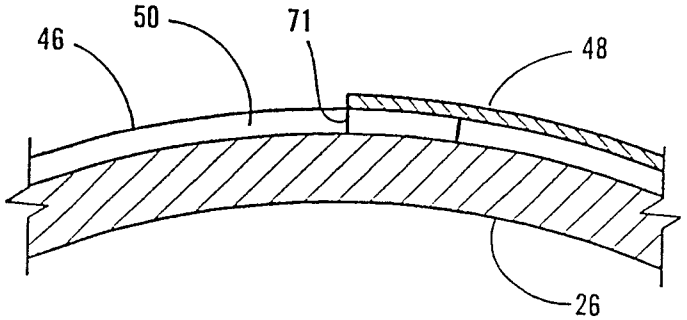
FIG. 9 is an enlarged sectional view similar to FIG. 8 showing the use of a groove damper to prevent escape of subatmospheric pressure from the grooves at the trailing end of a printing plate.

An alternative groove damper arrangement is illustrated in FIG. 9. In this, instead of providing the gate bars 70 and 84, short strips of material 71 are secured to the trailing end of each printing die 48, these strips 71 serving as a groove damper to prevent the escape of subatmospheric pressure from the grooves at the trailing end of the die.

Figure 10:
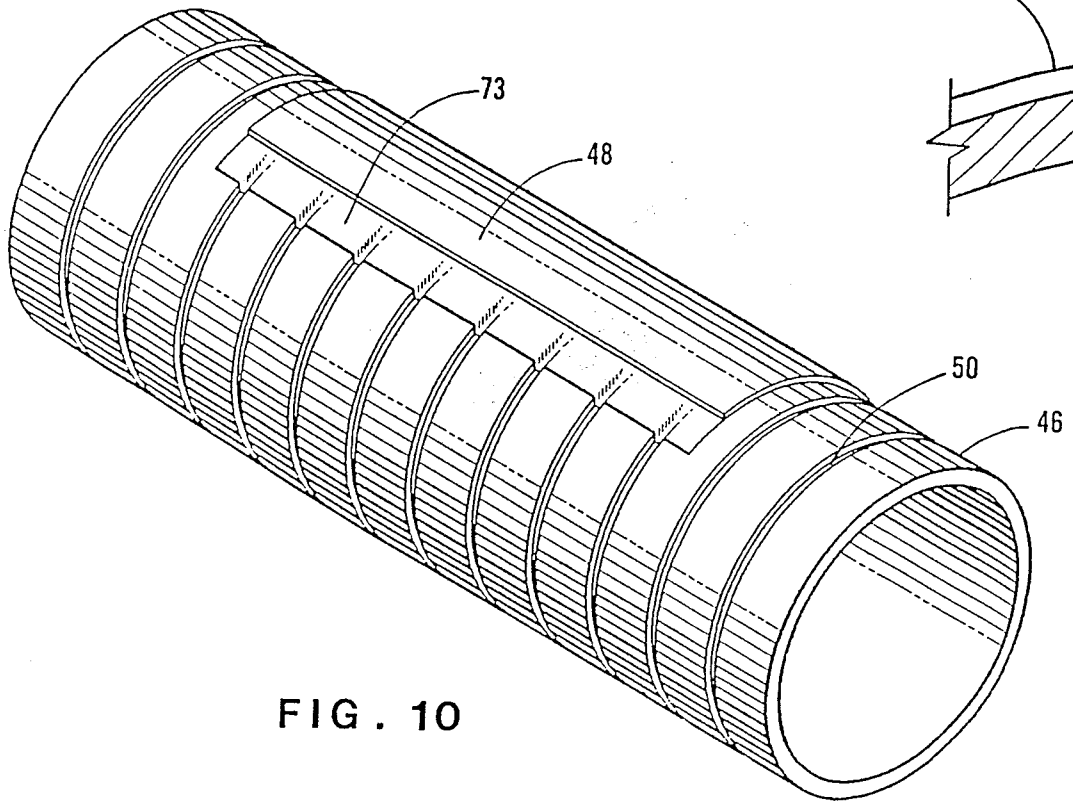
FIG. 10 is an isometric illustration showing the use of a flexible groove damper according to the invention to prevent the escape of subatmospheric pressure from the grooves at the trailing end of the printing plate.

FIG. 10 illustrates another, and advantageous, groove damper arrangement for sealing the grooves at the trailing end of the die 48. This involves securing to the end of the die a piece of thin, flexible plastic material 73 that will deform, under the influence of the subatmospheric pressure in grooves 50, into the grooves 50 along the trailing edge of the die 48. When this method is used, the grooves 50 are preferably rounded as shown to enable the plastic piece 73 to conform to the shape of the groove. The flexible material 73 may take the form of a thin (e.g. 0.02 inches) strip of flexible magnetic material, such as sold commercially by the 3M Company, that will adhere to the ferrous surface 46.

The preferred embodiment of the invention illustrated in FIGS. 11 to 17 will now be described. This embodiment is similar to the printing plate mounting apparatus previously described with reference to and illustrated in FIGS. 1 to 6 and 10. The printing cylinder 10, its connection to the vacuum source 28, and the manner of automatically applying vacuum only to the surface 46 of the printing cylinder 10 immediately below, and covered by, the printing die or plate 48 are essentially the same. The main improvements in the preferred embodiment relate to the valves for controlling supply of the vacuum to the printing plate and the construction of the trailing end of the printing plate.

Figure 11:
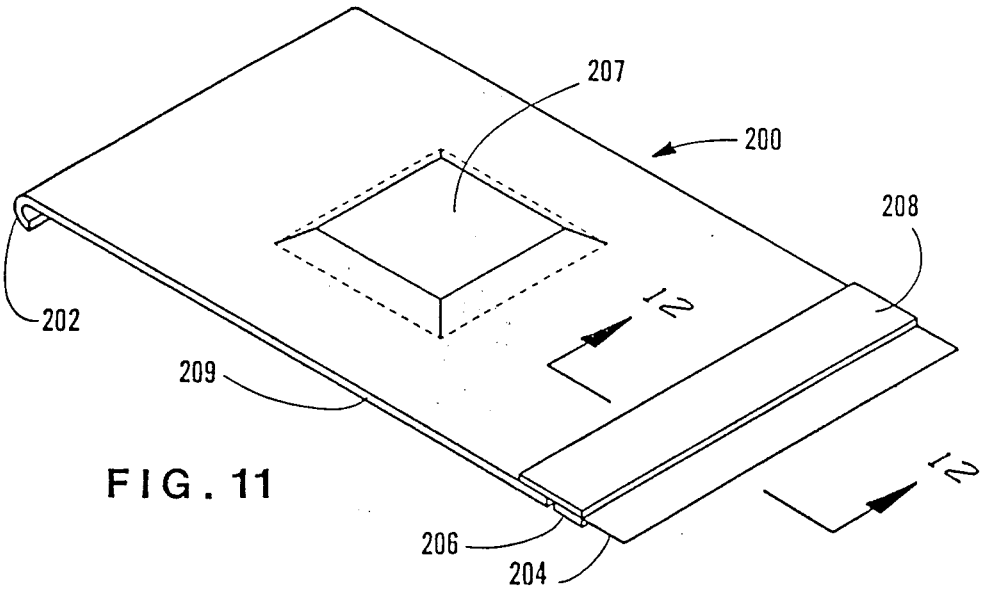
FIG. 11 is a perspective view of another embodiment of a printing plate according to the invention.

FIG. 11 illustrates a preferred flexible printing plate 200 in its flat orientation before it is applied to and curved around the printing cylinder. The leading end of this printing plate is shown having an inturned, U-shaped, hook-like portion 202 of the "Dorr" type for hooking into the stop bar 62 (see FIG. 3) of the printing cylinder. However, any other suitable form of leading end could be employed, such as the "Matthews" type shown in FIG. 6. The trailing end of the printing plate 200 is provided with a very thin, highly flexible, and stretchable fringe 204, a flexible magnetic strip 206, and an adhesive strip 208 securing the fringe 204 and the magnet 206 to the main body portion 209 of the printing plate. A printing die 207, having embossed thereon the matter to be printed, is secured on the main body portion 209.

Figure 12:
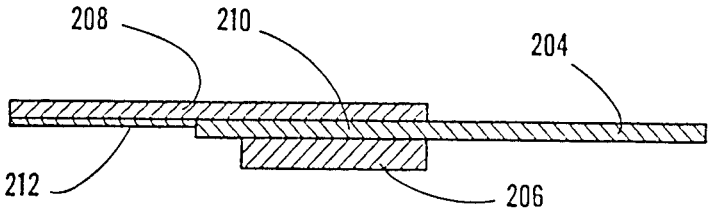
FIG. 12 is a section on the line 12—12 of FIG. 11.

FIG. 12 shows a section on the line 12—12 of FIG. 11 of this trailing end assembly without the remainder of the printing plate. The magnetic strip 206 is bonded with a suitable adhesive to a strip of flexible elastomeric material 210 which forms the fringe 204 extending to the rear (i.e. to the right in FIG. 12) of the magnetic strip 206. The strip 210 also extends a short distance forward (i.e. to the left in FIG. 12) of the magnetic strip 206. The adhesive strip 208 is applied, adhesive side down, over approximately half its width onto the forward portion of the elastomeric strip 210. The lefthand half of the adhesive strip 208 extends forwardly of the plastic strip 210 with an adhesive layer 212 downwardly exposed for securing to the main body portion of the printing plate. Before being applied to the printing plate, a tearoff protective strip may cover the adhesive layer portion 212.

Preferably, the plastic strip 210 is formed from very thin latex sheet material approximately 0.006 inch thick which is highly flexible and resiliently stretchable in any direction. This enables the fringe 204 to readily deform to the shape of the grooves in the printing cylinder 10 to form a seal thereagainst.

Such deformation is illustrated in FIG. 10 with the fringe 73. Preferably, the edges of the grooves 50 at the mounting surface of the printing cylinder are bevelled or otherwise chamfered. Suitable latex material for this fringe is made by The Hygenic Corporation of 1245 Home Avenue, Akron, Ohio 44310 and sold under the designation "Latex Rubber". The magnetic strip 206 is made by the 3M Company of St. Paul, Minn. 55144 and sold under the designation "Magnetic Tape". Typical dimensions of this assembly in the widthwise direction of FIG. 12 are: adhesive layer 212 one and a quarter inches; adhesive strip 208 two and a half inches; magnetic strip 206 one inch; elastomeric strip 210 two and three quarter inches of which the fringe 204 extends one and a quarter inches to the right of the magnetic strip 206, and also the elastomeric material 210 extends a quarter inch to the left of the magnetic strip 206. The magnetic strip 206 is 0.035 inch thick.

The magnetic strip 206 enables the trailing end of the printing plate to be readily positioned on the printing cylinder and held in position by magnetic attraction between the magnetic strip and the printing cylinder. The printing cylinder is usually made of steel or other metal having a ferrous content. This is particularly advantageous to retain the printing plate in position if the vacuum source 28 is not drawing a vacuum inside the printing cylinder 10, for example when the printing press is shut down overnight, or possibly during some printing plate changing operations.

Figure 14:
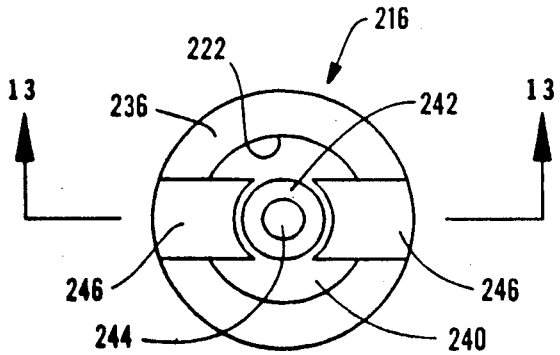
FIG. 14 is a top plan view of the valve of FIG. 13.
Figure 13:
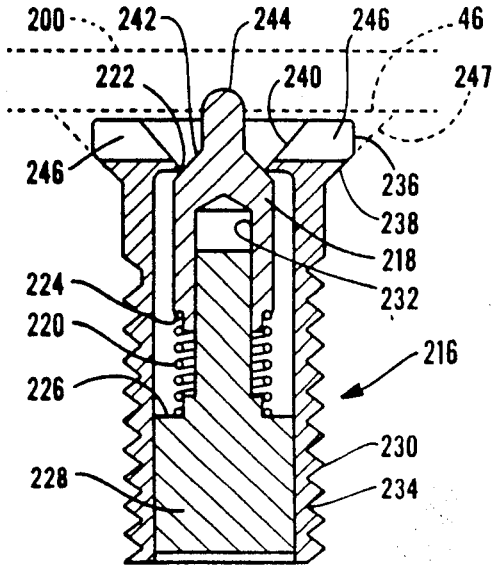
FIG. 13 is a section on the line 13—13 of FIG. 14 of a suction valve according to the invention.
Figure 15:
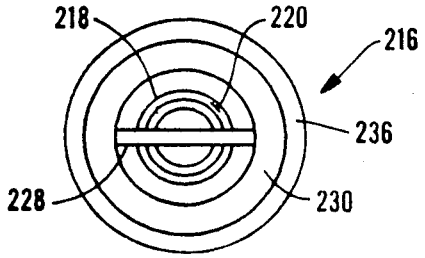
FIG. 15 is a bottom plan view of the valve of FIGS. 13 and 14.

FIGS. 13 to 15 show a preferred valve assembly 216 for mounting in the printing cylinder.

FIG. 13 is a longitudinal section of the valve assembly 216 on the line 13—13 of FIG. 14. A movable valve member 218 is resiliently biased by a coil spring 220 upwardly against a knife edge seat 222. The spring 220 is compressed between a shoulder 224 on the lower end of the valve member 218 and a shoulder 226 on a flat partition 228 extending diametrically across the interior of a cylindrical valve housing 230 and secured thereto. A reduced upper portion of the partition extends into a blind gore 232 in the valve member 218 to function as a guide for the latter. The exterior of the valve housing is screw threaded at 234 to enable the valve assembly to be screwed into a corresponding screw threaded hole in the printing cylinder 10. For this purpose the holes 52 in FIGS. 3, 4 and 6 may be screwthreaded. The upper end of the valve housing 230 is formed with a flange 236 having a frustoconical lower seating surface 238 and a frustoconical inner surface 240 which inclines downwardly and inwardly to the knife edge seat 222. The valve member 218 has a frustoconical land 242 adjacent the top and which seals against the knife edge seat 222. A small actuating stud 244 extends upwardly from the top of the land 242, through an open center of the flange 236, and protrudes a short distance above the top surface of the flange 236. Preferably, this distance of protrusion is of the order of one tenth of an inch. The top of the stud 244 is dome shaped. When the valve assembly 216 is screwed into the printing cylinder, the upper surface of the flange lies in, or just below, the printing cylinder mounting surface 46 (indicated in broken lines). The flange 236 has two diametrically opposed slots 246 formed therethrough, which when the valve assembly is installed in the printing cylinder communicate with the respective groove 50 in the surface 46 of the printing cylinder. To facilitate this communication, preferably the cylinder surface 46 is countersunk at 247 (shown in FIG. 13 in broken lines) around each screwthreaded hole 52, such countersinking being frustoconical, outwardly and upwardly inclined, and forming an air space around the flange 236 of each valve assembly. Thus, the exact disposition of the slots 246, when the valve assembly 216 is installed, is not important. However, it is possible to omit the countersinking 247 if the slots 246 are caused to align with the respective groove 50 in the cylinder surface 46.

FIG. 14 is a top plan view of the valve assembly 216 and shows the diametrically opposed slots 246 through the flange 236, and the stud 244, and the frustoconical surface 240 and land 242.

FIG. 15 is a bottom plan view of the valve assembly 216 and shows the plate-like partition 228 extending diametrically across the itnerior of the cylindrical valve housing 230.

Figure 16:
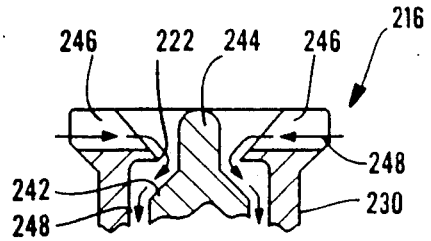
FIG. 16 is a partial view of the upper portion of the valve of FIG. 13, but in an open position.

FIG. 16 is a similar view to the upper portion of FIG. 13, but indicating by arrows 248 the air flow through the valve when open. This occurs when a flexible printing plate, such as printing plate 200 shown in broken lines, is placed on the mounting surface of the printing cylinder so contacting and automatically depressing the stud 244 so that it no longer protrudes above the surface of the printing cylinder. The land 242 is moved downwardly out of contact with the seat 222, and air is drawn by the vacuum inside the printing cylinder from the associated cylinder groove 50, through the slots 246, past the seat 222, and through the interior of the housing 230 into the interior of the printing cylinder via the hole 52 in which the valve is mounted. When the printing plate 200 is removed, the spring 220 closes the valve again. As previously explained with the embodiment of FIG. 1 to 6 and 10, any valves not covered by a printing plate, when positioned on the printing cylinder, will remain closed; in this instance these valves will be closed by the springs 220, and not by the vacuum in the printing cylinder.

The knife edge seat 222, in conjunction with the frustoconical land 242, also function to minimise the risk of paper fragments, and other debris associated with paper and cardboard sheets or cartons being printed, from collecting in and clogging the valve or otherwise adversely affecting its functioning. The knife edge seat 222 and the frustoconical land 242 provide a self clearing arrangement, with any such debris being swept away by the air flow.

Figure 17:
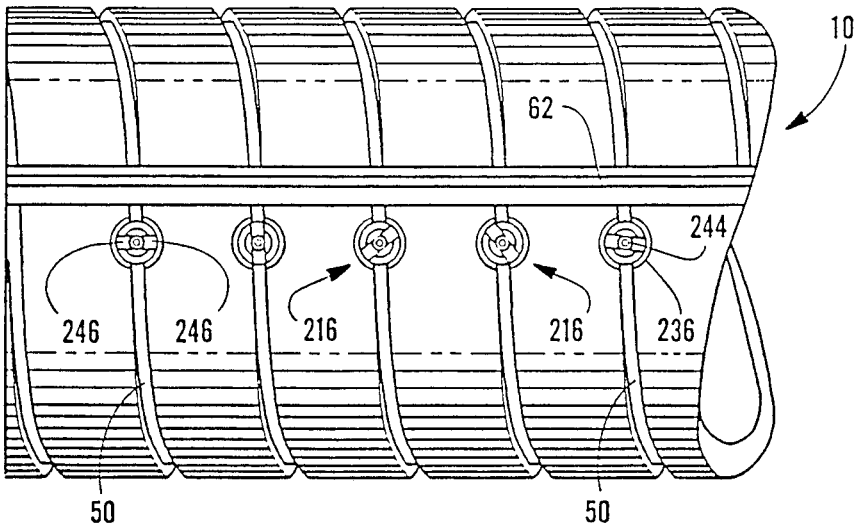
FIG. 17 is a fragmentary elevational view showing a modification of the printing cylinder of FIGS. 1, 2 and 3 and incorporating the valve of FIGS. 13 to 16.

FIG. 17 shows a partial elevatioal view of a modification of the printing cylinder of FIG. 1. A valve assembly 216, as shown in FIGS. 13 to 16, is screwthreaded into each hole 52 (FIG. 6), these valve assemblies extending in a line axially across the printing cylinder adjacent the trailing side of the stop bar 62. The slots 246 in each valve assembly are randomly disposed and communicate, via the appropriate countersinking 247, with the circumferential groove 50 in which the valve assembly is located. Due to these slots 246, the previously described recesses 56 may be retained if desired; however, such recesses 56 are preferably now more simply formed as the countersunk frustoconical seats receiving the flanges 236 with an air space therearound —the latter arrangement being illustrated in FIG. 17. The circumferential grooves 50 may be separate annular grooves perpendicular to the rotational axis of the printing cylinder. However, as shown in FIG. 17, the grooves 50 are formed as one continuous helical groove which is interrupted and divided into separate grooves 50 only by the stop bar 62. Such a helical groove gives manufacturing advantages over machining a plurality of parallel annular grooves. With this helical groove arrangement, when the printing plate is positioned, one of the helical sections communicating with an opened valve 216 may extend from under the right hand side edge (as viewed in FIG. 10 or 17) of the printing plate; this would provide leakage of the vacuum being drawn in that groove. However, such leakage associated with one such side extending groove has not been found to have any adverse effect. Should it be desired to prevent such leakage, then this could be accomplished by temporarily plugging that groove where it exits the side of the printing plate, or by forming a side fringe along all or a part of that side of the printing plate, the side fringe being similar to the trailing fringes 73 and 204. When the valve arrangement of FIG. 17 is used with the printing plate of FIGS. 10 or 11, the gate bars 70, 84 (see FIG. 3) serve no function and may be omitted if desired.

Typical dimensions employed for the grooves 50 of FIG. 17 are width one quarter of an inch, depth one eighth of an inch, with the plurality of helical grooves at two inch axial spacing between centers.

In operation of the various above embodiments of the printing plate mounting apparatus, the compressor 28 is turned on to apply subatmospheric pressure to the interior 26 of cylinder 10. A printing plate is selected for use; it can be a full-wrap plate extending from U-shaped hook 86 to the upstanding portion 68 of bar 62 (counterclockwise as viewed in FIG. 3), or a shorter one extending to bar 84 or still shorter, extending to bar 70 as previously explained. If a full-wrap plate is used, the bars 70 and 84 are pushed up (as viewd in FIG. 7) to place the notches 82 in alignment with the grooves 50 so that subatmospheric pressure can flow from the recesses 56 to the ends of the grooves 50 abutting the stop bar 62. If a three-quarter wrap plate is used, bar 84 is positioned to close off the grooves 50, and if a one-half wrap plate is used the bar 70 is positioned to close off the grooves 50. The U-shaped leading edge of the printing plate 48 is hooked in the U-shaped slot 86. In so doing, the valves 54 or studs 244 beneath the die 48 are caused to pivot clockwise or be depressed by the pressure of the printing plate thereby opening ports 52 which permits the subatmospheric pressure to be applied to the grooves 50 beneath the die. Of course, when the modified printing plate 200 is used, the bar 70 and 84 are not required, regardless of how long the plate 200 is. The flexible printing plate 48, 200 is guided around the cylinder 10 and held in place on the mounting surface 46 by the subatmospheric pressure in the portions of the grooves 50 beneath the plate. The printing section of the machine may then be operated in the normal manner.

If a printing plate 48 or 200 is used that does not include a U-shaped strip 88 at the leading edge, then the leading edge of the plate is merely placed against the upstanding portion 68 of bar 62 to align the plate on the cylinder. Doing so will also pivot the valves 54 or depress the valve members 218 in the same manner as described above so that installation of the die remains essentially the same.

When the printing run is completed, the compressor 28 is turned off which stops the application of subatmospheric pressure and automatically releases the printing plate from the mounting surface 46. The palte 48 is then merely unhooked from the U-shaped slot 86 and the cylinder 10 is ready for the next set-up. With the modified printing plate 200, the magnetic strip 206 shoudl first be lifted off the printing cylinder.

If desired, a conventional vacuum pressure switch (not shown) may be connected, for example, to the chamber 40 to detect the loss of subatmospheric pressure which might release the printing plate during operation. The switch can be connected to a stop circuit of the machine to stop it is subatmospheric pressure is lost. It has been found that it takes about 12 seconds for the subatmospheric pressure to bleed down enough to release the die whereas the machine will usually stop in about 6 seconds, giving a factor of 100% for stopping the machine prior to the printing plate being released. Since the printing plate is relatively light and flexible, no damage is like to occur should it be released in this manner. However, when using the modified printing plate 200, the magnetic strip 206 would tend to retain the plate in position and resist release.

It will be appreciated that the above embodiments of the invention provide simple and improved ways of mounting printing plates on printing cylinders, and require less time for mounting than is required by prior art arrangements.

It will also be appreciated that existing flexible printing plates can readily be modified in accordance with the present invention by application of the new trailing end assembly described above.

The above described embodiments, of course, are not to be construed as limiting the breadth of the present invention. Modifications, and other alternative constructions, will be apparent which are within the spirit and scope of the invention as defined in the appended claims.

What is claimed is:

1. Apparatus for mounting a printing plate, comprising:

a rotatable cylinder having a surface on which the printing plate is to be mounted;

means for connecting an interior of said cylinder to a source of vacuum;

a plurality of passages between said interior and said surface for application of vacuum to said surface;

valve means, associated with said passages, for opening and closing said passages to control said application of vacuum to said surface;

said surface having grooves therien, and said passages communicating with said grooves via said valve means for distributing the vacuum beneath said printing plate;

said valve means having depressible actuating members which protrude above said surface when said valve means close said passages;

each of said actuating members being associated with a respective one of said grooves, said actuating members being individually depressed by said printing plate when mounted on said surface thereover to effect application of vacuum to those only of said grooves covered by said printing plate;

said grooves extending transversely to and being spaced apart along an axial direction of said cylinder;

said valve means comprising a plurality of valve assemblies disposed in said passages, each valve assembly comprising a spring-loaded valve member movable radially with respect to said cylinder inside a housing having a valve seat, said housing having a flange recessed into said surface, said flange having a slot therein communicating with a respective one of said grooves and placing that groove in communication with the valve member.

2. Apparatus for mounting a printing plate, comprising:

a rotatable cylinder having a surface on which the printing plate is to be mounted;

means for connecting an interior of said cylinder to a source of vacuum;

a plurality of passages between said interior and said surface for application of vacuum to said surface;

valve means, associated with said passages, for opening and closing said passages to control said application of vacuum to said surface;

said surface having grooves therein, and said passages communicating with said grooves via said valve means for distributin the vacuum beneath said printing plate;

said valve means having depressible actuating members which protrude above said surface when said valve means close said passages;

each of said actuating members being associated with a respective one of said grooves, said actuating members being individually depressed by said printing plate when mounted on said surface thereover to effect application of vacuum to those only of said grooves covered by said printing plate; and further including said printing plate, said printing plate comprising:

a flexible body portion having a leading edge and a trailing edge, said edges extending in an axial direction of said cylinder when said printing plate is mounted thereon; and a strip of highly flexible and pliable sheet material secured to said body portion and forming a fringe extending from said trailing edge, said fringe being readily deformable into any of said grooves covered thereby to seal such grooves at the location of said trailing edge under the action of vacuum distributed by such grooves when said printing plate is held in position on said printing cylinder by said application of vacuum.

3. The apparatus of claim 2, wherein said printing plate has a magnetic strip connected thereto adjacent said trailing edge.

4. Apparatus for mounting a flexible printing plate, comprising:

a printing cylinder having a surface upon which a printing plate is mounted;

means for applying subatmospheric pressure inside said cylinder;

means for selectively applying said subatmospheric pressure to said surface from inside said cylinder;

said selectively applying means including a plurality of depressible actuating members protrudable above said surface;

those of said actuating members contacted by said printing plate being depressed thereby to effect application of said subatmospheric pressure to beneath said printing plate to draw said plate against said cylinder;

said selectively applying means comprising a plurality of valve assemblies including knife edge seats engageable by lands on valve members;

said surface having grooves therein communicating with said selectively applying means, said grooves distributing said application of subatmospheric pressure beneath said printing plate; and said printing plate having a trailing edge with a thin, flexible and readily deformable fringe extending therefrom, said fringe being drawn into those of said grooves covered thereby to seal those grooves at locations adjacent said trailing edge.

5. A printing plate, comprising:

a flexible body portion having a leading edge and a trailing edge;

a printing die secured on said body portion between said edges and carrying matter to be printed;

a separate strip of highly flexible and pliable sheet material connected by adhesive to said body portion and forming a fringe extending from said trailing edge;

said sheet material having a thickness significantly less than that of said body portion;

said fringe being readily deformable by vacuum into vacuum distribution grooves of a printing roller upon which the printing plate is mounted and held in position by vacuum, said fringe sealing such grooves adjacent said trailing edge;

a strip of magnetic material juxtaposed said trailing edge and connected to said body portion;

said printing die being disposed on an upper surface of said body portion;

said strip of magnetic material being bonded with adhesive to an undersurface of said fringe;

an adhesive strip extending along said trailing edge and connecting said fringe to said body portion; and a portion of said adhesive strip being adhered to said upper surface of said body portion adjacent said trailing edge, and another portion of said adhesive strip being adhered to an upper surface of said fringe at a location above said magnetic strip.

6. Apparatus for mounting a printing plate, comprising:

a rotatable cylinder having a surface on which the printing plate is to be mounted;

means for connecting an interior of said cylinder to a source of vacuum;

a plurality of passages between said itnerior and said surface for application of vacuum to said surface;

valve means, associated with said passages, for opening and closing said passages to control said application of vacuum to said surface;

said surface having grooves therein, and said passages communicating with said grooves for distributing the vacuum beneath said printing plate;

said grooves extending transversely to and being spaced apart along an axial direction of said cylinder;

a stop bar recessed in said surface, said stop bar extending in said axial direction of said cylinder and traversing said grooves to form a closed beginning of each groove;

said valve means having a plurality of depressible actuating members which protrude above said surface when said valve means closes said passages, said actuating members being individually depressed by said printing plate when mounted on said surface thereover to effect application of vacuum to said surface beneath said printing plate;

said valve means comprising a plurality of valves, each of said valves being disposed in a respective one of said passages and having a respective one of said actuating members of actuation thereof;

said valves being disposed adjacent said stop bar and communicating with said grooves at said closed beginning of each groove;

each valve comprising a spring-loaded valve member movable radially with respect to said cylinder inside a housing having a valve seat in the form of a knife edge;

an extension of each valve member protruding axially outward beyond the valve seat of the respective valve and forming the actuating member of that valve;

each said valve member having a frustoconical land which, when the valve is closed, engages the valve seat thereof;

said housing having a flange recessed into said surface, said flange having a slot therein communicating with a respective one of said grooves and placing that groove in communication with the respective valve member; and each said housing having an open radially inner end and a through passage from the knife edge valve seat thereof to said open radially inner end thereof, said passage allowing paper fragments and other debris to pass therethrough and said knife edge valve seat cooperating with said frustoconical land to provide a self clearing arrangement for such paper fragments and other debris.

7. Apparatus for mounting a printing plate, comprising:

a hollow cylinder mounted for rotation about a central axis and having an outer cylindrical surface on which a printing plate is to be mounted;

means for connecting an interior of said cylinder to a source of vacuum;

said surface having grooves therein extending transversely to and being spaced apart along said axis;

passages in said cylinder respectively connecting said interior to said grooves for application of vacuum to said grooves;

a valve in each said passage for opening and closing the respective passage to control said application of vacuum to the respective groove;

each said valve having a depressible valve member which protrudes above said surface when the valve closes the respective passage, each said valve member being individually depressed by the printing plate when mounted on said surface over the respective valve member to open the respective passage;

each said valve having a housing with a flange at an outer end and a screw-threaded portion at an inner end;

each said valve housing being screwed into the respective passage;

a plurality of recesses in said surface, each recess communicating with and merging into a respective one of said grooves;

the flanges of said valve housings being seated in said recesses with a space around an outer periphery of each flange between the respective flange and a periphery of the respective recess; and a slot in each flange extending between the respective valve member and said space around the flange to provide communication between the respective valve member and the respective groove regardless of any final rotational position of each valve housing when screwed into the respective passage.

8. Apparatus for processing cardboard sheets, comprising:

a rotatable cylinder having a surface upon which a die is mountable;

means for applying subatmospheric pressure inside said cylinder;

means for selectively applying said subatmospheric pressure to said surface from inside said cylinder;

said selectively applying means comprising a plurality of valve assemblies mounted in said cylinder and having depressible actuating members protrudable above said surface;

those of said actuating members contacted by said die when applied to said surface being depressed thereby to effect application of said subatmospheric pressure to beneath said die to draw said die against said surface; and each said valve assembly comprising:

a hollow housing open at a lower end and having a knife edge valve seat surrounding an opening at an upper end nearer said surface than said lower end, said housing having a central axis passing through said open lower end and said opening, and an interior of said housing extending from said opening to said lower open end;

a valve member having an upwardly tapered land engageable with said knife edge valve seat in a closed position of said valve assembly;

resilient means for resiliently urging said valve member upwardly against said valve seat;

said valve member having one of said actuating member extending upwardly fromsaid land;

said valve member having a blind bore in a lower portion below said land;

a plate disposed in said housing and extending lengthwise along said axis;

said plate extending widthwise transversely to said axis and a lower portion of said plate being connected to said housing;

an upper portion of said plate engaging in said blind bore to locate said valve member while allowing movement of said valve member relative to said plate upper portion;

said valve member being movable downward along said plate upper portion upon depression of said one of said actuating members to move said tapered land away from said valve seat and allow air to be drawn through said opening at said upper end and pass out through said open lower end; and said plate being thin relative to said interior to provide, in conjunction with said knife edge seat and said tapered land, a free and relatively unobstructed passage of said air through said housing upon depression of said one actuating member to mitigate paper fragments and other debris clogging the valve assembly.

9. The apparatus of claim 8, wherein said resilient means comprises a coil spring surrounding said plate upper portion.

10. The apparatus of claim 8, wherein:

said housing has an exterior flange at said upper end;

said flange having an inner peripheral surface which tapers downwardly and inwardly and termiantes at said knife edge seat;

a slot in said flange extending transversely to said central axis from said inner peripheral surface to an outer periphery of said flange; and said housing having an exterior screw thread.

11. The apparatus of claim 8, wherein said housing interior is cylindrical and said plate extends transversely along a diameter of said cylindrical interior.

* * * * *

UNITED STATES PATENT AND TRADEMARK OFFICE

CERTIFICATE OF CORRECTION

PATENT NO. : 4,744,297

DATED : May 17, 1988

INVENTOR(S) : Sardella et al

It is certified that error appears in the above-identified patent and that said Letters Patent is hereby corrected as shown below:

In Claim 2: at column 13, line 23 of the Patent, change "distributin" to --distributing--.

In Claim 6: at column 14, line 49 of the Patent, change "itnerior" to --interior--; and at column 15, line 14 of the Patent, change "axially" to --radially--.

In Claim 8: at column 16, line 39 of the Patent, change "ber" to --bers-- and also change "fromsaid" to --from said--.

In Claim 10: at column 17, second line of the Patent, change "termiantes" to --terminates--.

Signed and Sealed this

First Day of November, 1988

*Attest:*

DONALD J. QUIGG

*Attesting Officer*

*Commissioner of Patents and Trademarks*